United States Patent [19]

Verr

[11] 4,270,121

[45] May 26, 1981

[54] CIRCUITRY FOR BURGLAR ALARM ANNUNCIATOR

[76] Inventor: Raymond E. Verr, 6614 S. Dorsey La., Tempe, Ariz. 85283

[21] Appl. No.: 138,889

[22] Filed: Apr. 10, 1980

[51] Int. Cl.[3] ..... G08B 29/00

[52] U.S. Cl. ..... 340/514; 340/506; 340/508; 340/513; 340/524

[58] Field of Search ..... 340/514, 515, 516, 517, 340/513, 525, 506, 507, 508, 524, 521, 522

[56] References Cited

U.S. PATENT DOCUMENTS

| | | | |
|---|---|---|---|
| 3,686,667 | 8/1972 | Schulz | 340/514 |
| 3,689,906 | 9/1972 | Levy | 340/514 |
| 3,924,256 | 12/1975 | Cohen | 340/513 |

*Primary Examiner*—John W. Caldwell, Sr.
*Assistant Examiner*—Donnie L. Crosland
*Attorney, Agent, or Firm*—Cahill, Sutton & Thomas

[57] ABSTRACT

An annunciator system includes circuitry which, upon depressing of a momentary switch isolating the annunciator system from closed loop inputs of an electronic burglar alarm sensing unit, identifies the status of each access switch in a closed loop circuit containing the plurality of access switches. The annunciator system also indicates the integrity of electrical connections to the respective access switches and to an audible alarm unit.

9 Claims, 3 Drawing Figures

TO FIG. 1B
LIVING ROOM
DINING ROOM
VOLTAGE REGULATOR

ACCESS CLOSED WHEN UNLIGHTED
MAT - LIVING ROOM.
MAT - GARAGE ENTRY
MAT - ARCADIA DOOR
67
79
73
29 A,B,C
25A,B
OFF
OFF
ACCESS CLOSED WHEN LIGHTED
ALARM DEVICES
FRONT DOOR
BAY WINDOW
SIDE DOOR
GARAGE
MASTER BDRM.
BOYS' BDRM.
GIRLS' BDRM.
33
37
39
35
235
236
237
238
131

GARAGE
21B
21'
19
17
17A
15
15A
23A
23
21
21A
129
127
125
123
119
MAIN ENTRY
13
13A
1
97
93
(+)(−)
FROM FIG. 1A

CIRCUITRY FOR BURGLAR ALARM ANNUNCIATOR

BACKGROUND OF THE INVENTION

1. Field of the Invention

The invention relates to burglar alarm systems, and more particularly to an annunciator system which provides a visual indication of the status of each individual access switch contained in a burglar alarm system.

2. Description of the Prior Art

Burglar alarm systems generally include a power supply, one or more audible alarm units, a plurality of contact switches or access switches located to detect opening of doors, windows or the like. The contact switches or access switches are interconnected to each other and are also connected to a burglar alarm sensing unit. One type of system, referred to as a closed loop circuit burglar alarm system, is commonly utilized, wherein electric current of a predetermined level flows through all of the access switches, which are connected in a series, and which are normally in a closed position when the automatic burglar alarm system is "armed" and is "guarding" the premises in which the burglar alarm system is installed. When a door, window or the like is opened or an intruder steps on a switch concealed in hallway carpet or the like, a corresponding one of the normally closed access switches is opened, interrupting the predetermined current level. The burglar alarm sensing system detects the interruption of the current level and causes the audible alarm unit to sound.

Before a burglar alarm system is "armed" (so that it will emit an alarm sound or signal if a normally closed access switch is opened) it is necessary to know if all of the access switches are properly closed, since if the burglar alarm system is armed with one or more of the access switches opened, the burglar alarm set will be "set off" or actuated, causing the alarm to sound. For a premises with a large number of access switches, the task of determining the status of each individual access switch can be time consuming and therefore costly. Some known burglar alarm systems include annunciator panels which are centrally located in a premises, which annunciator panels include display lights to indicate the presense of an open access switch within a predetermined "zone". Each such "zone" includes a plurality of access switches. U.S. Pat. No. 3,689,906 discloses such a system. Other known systems include display lights located at or near each individual access switch, each such display light indicates whether the corresponding nearby particular access switch is opened or closed. U.S. Pat. No. 3,924,256 discloses such a system. If it is determined that all of the access switches in prior burglar alarm systems are not closed, it is then necessary for an operator to inspect each access of the premises to be sure that all entries, and hence all access switches, of the premises are closed before activating the burglar alarm system. There clearly is an unmet need for an annunciator system which enables an operator to determine at a glance whether all access switches in a burglar alarm system are in their proper state or configuration before arming the burglar alarm system, to alleviate the need of having to actually inspect each entry or access to the premises.

Accordingly, it is an object of the invention to provide an annunciator system which enables an operator to determine at a glance which access switches in a burglar alarm system are open and/or closed.

The circuitry, wiring, and status indicators systems of most prior burglar alarm systems and annunciator systems associated therewith are very complex and costly.

Accordingly, another object of the invention is to provide a simple, low cost annunciator system for burglar alarm systems.

Since many prior burglar alarm systems which have already been installed do not have a satisfactory annunciator system which can be easily incorporated into pre-existing annunciator systems.

Another object of the system is to provide a low cost annunciator system which can be inexpensively and simply connected to a previously installed burglar alarm system.

A novelty search directed to the present invention uncovered the following U.S. Patents in addition to the two mentioned above: U.S. Pat. Nos. 3,821,733; 3,696,374, 4,015,256; and 2,971,186.

It is another object of the invention to provide an annunciator system for use in conjunction with alarm and/or monitoring systems, which annunciator system overcomes the shortcomings of the known prior art.

SUMMARY OF THE INVENTION

Briefly described, and in accordance with one embodiment thereof, the invention provides an annunciator system which enables an operator to easily determine the status of all access switches in a burglar alarm system at a single glance. In the described embodiment of the invention, a momentary switching device, when in a relaxed configuration, connects a closed loop circuit to a pair of sensing inputs of an electronic sensing unit, the closed loop circuit including a plurality of series connected access switches. When the momentary switch is actuated to cause the annunciator system to display the status of each access switch in the system, the closed loop circuit is disconnected from the sensing inputs of the sensing unit. The annunciator system includes a plurality of light emitting diodes, each corresponding to a respective one of the access switches. The actuated momentary switch couples the anodes of all of the light emitting diodes to a first supply voltage. The cathodes of each light emitting diodes is connected, respectively, to a first terminal of the access switch to which that light emitting diode corresponds. The first terminal of each access switch is coupled to a second terminal of an adjacent access switch by means of a corresponding first diode which is reversed biased during the operation of monitoring the status of the access switches. The isolating diodes are forward biased when the burglar alarm system is "armed" to detect opening of a normally closed access switch caused by an intrusion into a protected premises. The second terminal of each of the access switches is connected to the anode of a corresponding second diode. The cathodes of all of the second diodes are connected together to a second supply voltage. In the described embodiment of the invention, a second momentary switch, when actuated, disconnects the negative supply voltage from the cathodes of the second diodes and connects the negative supply voltage to the cathodes of each of the light emitting diodes by means of a plurality of corresponding third diodes, thereby causing a test current to flow through each of the light emitting diodes. This enables the operator to test each light emitting diode to be sure that it is operative.

In the described embodiment of the invention, a switching device connects an audible alarm device to a pair of alarm outputs of the burglar alarm sensing device when the burglar alarm system is armed. The switching system disconnects the audible alarm unit from the burglar alarm outputs and connects it in series with the closed loop circuit. One of the light emitting diodes is connected in series with the audible alarm device when the first momentary switch is actuated, thereby indicating if the electrical connection to the audible alarm device has been broken.

In the described embodiment of the invention, if the burglar alarm system includes a plurality of normally open access switches, the first terminal of each normally open access switch is connected to the cathode of a corresponding light emitting diode and to the respective anodes of a corresponding first diode and a corresponding second diode. The anode of each such light emitting diode is connected to the anodes of each of the other such light emitting diodes and to the cathodes of the corresponding first and second diodes and are also connected to the momentary switch to an open loop input of the burglar alarm sensing unit when the burglar alarm system is armed, and is disconnected from the open loop input and connected to the first supply voltage when the annunciator circuit is operated to display the status of normally open access switches. The second terminal of each of the normally open access switches is connected to the second supply voltage when the momentary switch is relaxed, and is disconnected therefrom when the momentary switch is actuated to operate the annunciator circuit is operated to display the status of all of the access switches. The cathodes of each of the third test diodes is connected by means of the second momentary switch to the second supply voltage, which the first momentary switch actuated, to test each of the light emitting diodes connected to the respective normally open access switches.

DESCRIPTION OF THE INVENTION

Figure 1A:
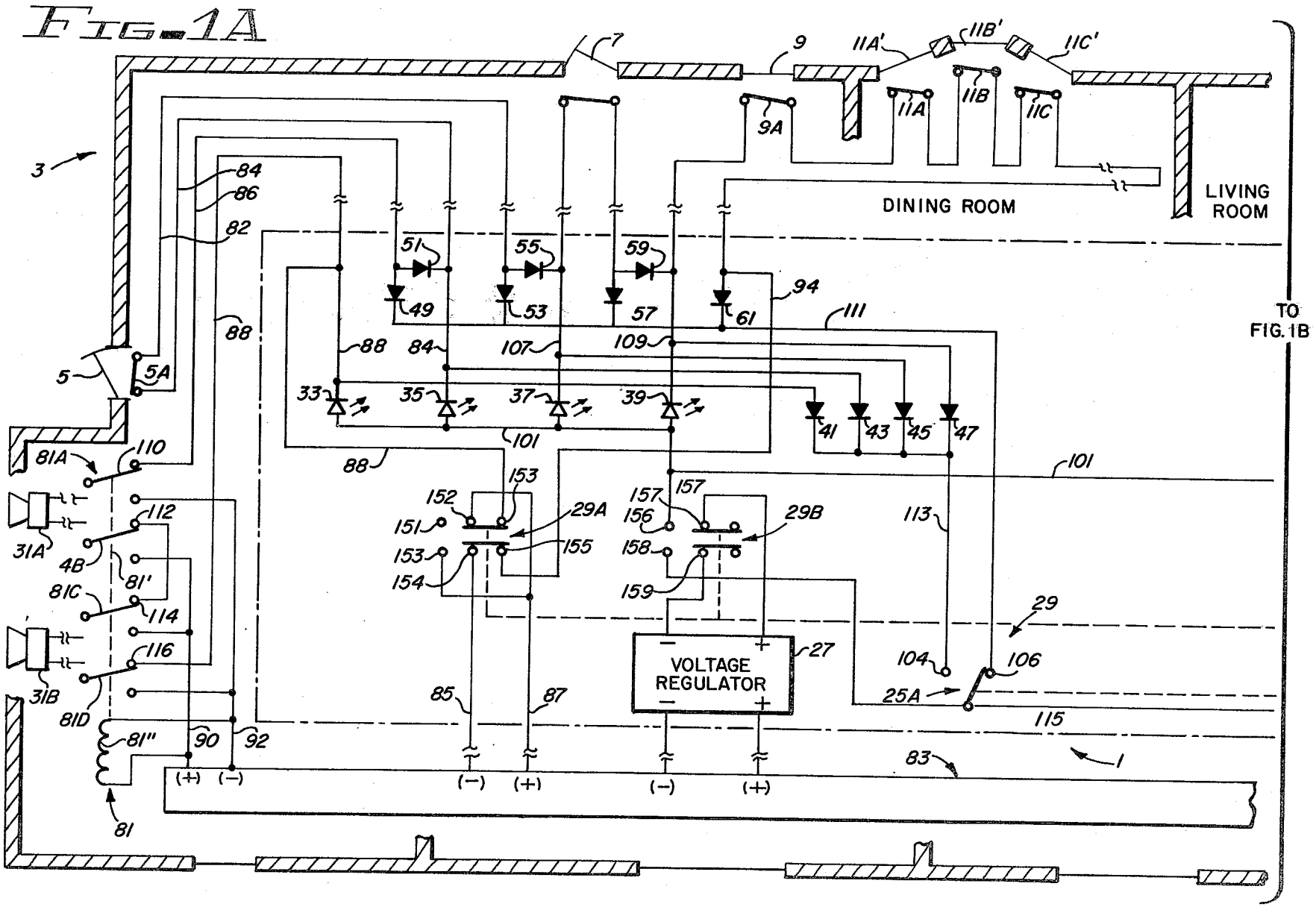
FIG. 1A is a partial schematic diagram illustrating the annunciator system of the present invention in a burglar alarm system.
Figures 1B, 2:
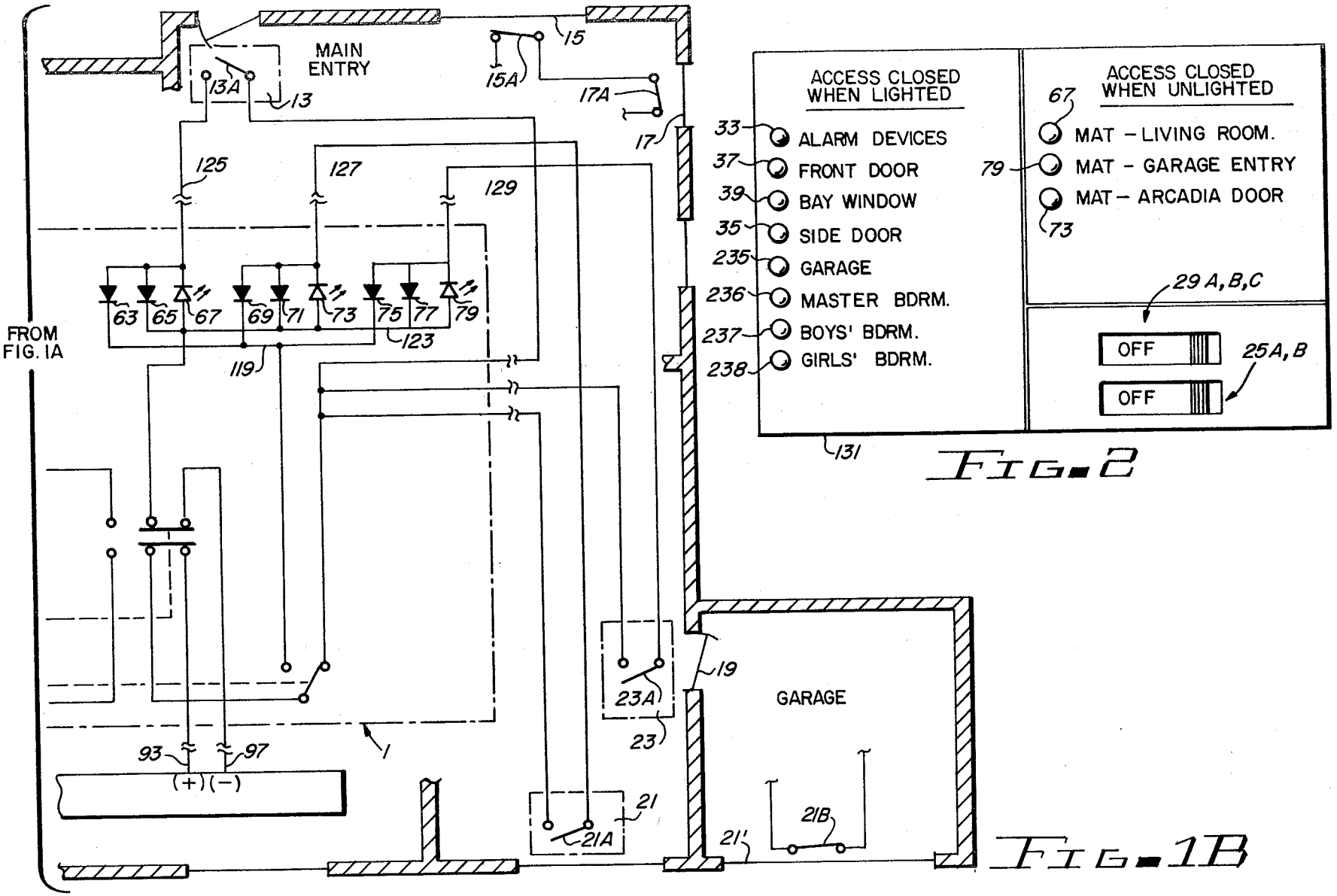
FIG. 1B is a partial schematic drawing of a second portion of the system shown in FIG. 1A.
FIG. 2 illustrates an annunciator panel in which the switches and light emitting diodes of the system of FIGS. 1A and 1B are mounted.

Referring now to the drawings, particularly FIGS. 1A and 1B, an annunciator system 1 is connected to a burglar alarm system for protecting a house 3. Reference numeral 83 generally indicates an electronic burglar alarm sensing system of the type which is connectable to a "closed loop" connection of a plurality of normally closed series-connected access switches, each of which will be opened when a corresponding window, door or other access barrier is opened. Conductors 87 and 85 are connected, respectively, to the positive end and negative closed-loop inputs of burglar alarm sensing unit 83. (As subsequently explained, with reference to FIG. 1B, reference numeral 83 is also untilized to designate an "open loop" burglar alarm sensing unit which is used to sense closure of normally open access switches.) In FIGS. 1A and 1B, house 3 includes a plurality of doors and windows, for example windows 5, 9, 15, and 17. House 3 also includes doors 7, 13 and 19 and further includes a bay window having window sections 11A, 11B, and 11C. All of the above mentioned doors and windows are assumed to be openable. Normally closed access switches 5A, 7A, 9A, 11A, 11B and 11C are connected in series relationship with each other to form a closed loop circuit coupled to connectors 85 and 87 when the burglar alarm system is operating in an "armed" mode.

First and second audible alarm units, such as sirens or alarm units 31A and 31B, are turned on or actuated by means of relay 81. Relay 81 includes a first pair of ganged switches 81A and 81B and a second pair of ganged switches 81C and 81D, the two pairs of switches being ganged together, as indicated by dotted line 81'. Terminals 110, 112, 114, and 116 of relay 81 are connected such that a low impedance path (resembling a short circuit) exists between conductors 86 and 88 when relay 81 is not actuated by an alarm output signal produced on conductors 90 and 92 by sensing circuit 83. More specifically, when relay 81 is not actuated by sensing unit 83, conductor 86 is connected to relay terminal 110, which is connected by means of wiper 81A to one terminal of siren 31A. The outer terminal of siren 31A is connected to wiper 81B, which is connected to relay terminal 112. Relay terminal 112 is shorted to relay terminal 114, which is connected by means of wiper 81C to one terminal of siren 31B. The other terminal of siren 31B is connected by means of wiper 81D to relay terminal 116, which is connected to conductor 88.

If relay 81 is actuated by sensing unit 83, a voltage difference provided between conductors 90 and 92 (in response to an intrusion and a corresponding opening of a normally closed access switch) is applied across the input terminals of sirens 31A and 31B, causing a loud audible sound to be emitted thereby.

Conductor 86 is connected to the anode of diode 51. The cathode of diode 51 is connected to conductor 84, which is connected to one terminal of normally closed access switch 5A. The other terminal of access switch 5A is connected to conductor 82, which also is connected to the anode of diode 55. The cathode of diode 55 is connected to one terminal of normally closed access switch 7A, the other terminal of which is connected to the anode of diode 59. The cathode of diode 59 is connected to one terminal of normally closed access swith 9A, the other teminal of which is connected to one terminal of normally closed access switch 11C, the other terminal of which is connected to conductor 94.

Conductor 94 is connected to terminal 155 of momentary switch 29A. Conductor 88 is connected to terminal 153 of momentary switch 29A.

At this point it should be noted that annunciator circuit 3 of FIGS. 1A and 1B includes three separate momentary switches 29A, 29B, and 29C, all three of which are ganged together (as indicated by dotted line 29). A spring-loaded single slide control is slid from right to left to actuate all three of momentary switches 29A, 29B, and 29C, as some of the slide control is released by an operator, the slide control returning to its original position. The three ganged momentary switches, hereinafter referred to as momentary switches 29A, 29B, 29C are shown in their relaxed state in FIGS. 1A and 1B. As will become clear subsequently, when switches 29A, 29B, 29C is in its relaxed configuration, the previously described series connected normally closed access switches and sirens 31A and 31B are effectively connected in series to form a closed loop which is connected to current sensing input conductors 85 and 87 of sensing unit 83.

Each of momentary switches 29A, 29B and 29C includes an upper slide plate and a lower slide plate which slide from right to left with the above mentioned slide control. As seen in FIG. 1A, the upper slide plate of momentary switch 29A shorts terminals 152 and 153 together while the lower slide plate thereof shorts terminals 154 and 155 together when momentary switch 29A is in its "relaxed" configuration.

Thus, assuming that all of the above mentioned normally closed access switches are closed and that relay 81 is not actuated, a continuous low resistance path can be traced from conductor 87 to conductor 85. The path passes through terminals 152 and 153 to conductor 88. The path then continues from conductor 88 through relay switch terminal 116, sirens 31B and 31A, to conductor 86. The electrical path then continues through conductor 86 through forward biased diode 51 (assuming that a positive bias voltage is applied to conductor 87 with respect to conductor 85, causing a predetermined current to flow through the above described path). The path then continues through access switch 5A, and through conductor 82. The path continues from conductor 82 into the forward biased diode 55, through access switch 7A, and through forward biased diode 59. Next, the low resistance path continues through access switch 9A and through series connected switches 11A, 11B, and 11C. The path then returns via conductor 94 to terminal 155 of momentary switch 29A and through the lower slide plate thereof to conductor 85.

If the above path is interrupted due to opening of one of the normally closed access switches by an intruder as he attempts to force open a corresponding door or window, sensing unit 83 actuates relay 81, applying a positive voltage between conductors 90 and 92 to the terminals of sirens 31A and 31B, causing them to emit a loud alarm sound.

Still referring to FIG. 1A, light emitting diode 33 has its cathode connected to conductor 88 and its anode connected to conductor 101. Conductor 88 is also connected to the anode of diode 41, the cathode of which is connected to conductor 113. Conductor 113 is connected to terminal 104 of second momentary switch 25A, which is ganged (as indicated by dotted lines 25') to momentary switch 25B. (As subsequently explained, ganged momentary switches 25A, 25B when actuated, tests all of the light emitting diodes in FIGS. 1A and 1B.)

Light emitting diodes 35, 37, and 39 also have their respective anodes connected to conductor 101. Conductor 101 is connected to terminal 156 of momentary switch 29B. Terminal 157 of momentary switch 29B is connected to the positive input of voltage regulator 27. The negative input of voltage regulator 27 is connected to terminal 159 of momentary switch 29B. As can be seen in FIG. 1A, when momentary switch 29B is in its relaxed configuration, the positive and negative terminals of voltage regulator 27 are not connected to terminals 156 and 158 of momentary switch 29. Terminal 158 of momentary switch 29B is connected to conductor 115, which is also connected to the wiper of momentary switch 25A.

When momentary switches 29A, 29B, 29C are depressed, voltage regulator negative output voltage is applied to conductor 115, while the positive voltage output thereof is applied to conductor 101.

The cathodes of light emitting diodes 33, 35, 37 and 39 are connected, respectively, to conductors 88, 84, 107 and 109. Conductor 84 is connected to the anode of diode 43, the cathode of which is connected to conductor 113. Conductor 107 is connected to the anode of diode 45, the cathode of which is connected to conductor 113. Conductor 109 is connected to the anode of diode 47, the cathode of which is also connected to conductor 113. Conductors 107 and 109 are connected, respectively, to the cathodes of diodes 55 and 59. Conductor 86 is connected to the anode of diode 51 and conductor 84 is connected to the cathode thereof.

Thus, it can be seen that if slide control of momentary switches 29A, 29B, 29C is slid to the left, sensing unit 83 is disconnected from the closed circuit connection of the above mentioned access switches, and voltage regulator 27 is connected to apply a positive voltage between terminals 158 and 156 of momentary switch 29B.

If momentary switch 25A is then actuated so that its wiper connects conductor 115 to terminal 104 the negative outlet of voltage regulator 27 is applied to conductor 113, while the positive output of voltage regulator 27 is applied to cathodes of light emitting diodes 33, 35, 37 and 39. This causes currents to flow through each of light emitting diode 33, 35, 37 and 39, allowing the operator to determine at a glance whether those light emitting diodes are operative.

If momentary switch 25A, 25B is not actuated while momentary switch 29A, 29B, 29C is actuated, the positive output of voltage regulator 27 is applied to the anodes of each of light emitting diodes 33, 35, 37 and 39 and the negative output voltage of voltage regulator 27 is supplied via the wiper of momentary switch 25A to terminal 106 thereof and hence, to conductor 111. Still assuming that each of normally closed access switches 5A, 7A, 9A, 11A, 11B, and 11C remain closed, the voltage difference between conductors 101 and 111 causes a current to flow through each of light emitting diodes 33, 35, 37 and 39, thereby indicating to the operator that all of the normally closed access switches are closed and that sirens 31A and 31B are properly connected. More specifically, the current to light emitting diode 33 flows through conductor 88, sirens 31A and 31B, conductor 86 and diode 49 to conductor 111. The current through light emitting diode 35 flows through access switch 5A and diode 53 to conductor 111. The current through light emitting diode 37 flows through access switch 7A and diode 57 to conductor 111. Similarly, the current of light emitting diode 39 flows through access switches 9A, 11A, 11B, and 11C and diode 61 to conductor 111. Thus, the fact that light emitting diode 33 is on indicates to the operator that sirens 31A and 31B are properly connected. Similarly, the fact that light emitting diode 35 is on indicates that side door 5 is closed. The light from light emitting diode 37 indicates to the operator that door 7 is closed. However, the light from light emitting diode 39 indicates to the operator that window 9 and panes 11A', 11B' and 11C' are all closed. Thus, annunciator circuit 1 can be utilized to indicate the status of individual switches or access switches and groups of access switches which are located close together.

The above described annunciator circuitry requires very few circuit elements, and can be easily wired into preinstalled closed loop burglar alarm systems.

Referring now to FIG. 2, a display panel surface which can be one surface of a printed circuit board has annunicator circuitry 1 implemented on the opposite side thereof. The annunciator panel surface of FIG. 2 includes all of the light emitting diodes shown in FIGS. 1A and 1B positioned adjacent corresponding indicia or legends indicating the corresponding access points to which the respective light emitting diodes correspond. (For convenience, connections of several of the access switches, such as 21B, 15A, and 17A, are not illustrated). In FIG. 2, light emitting diode 235 corresponds to garage access switch 21A, for example. Similarly, light emitting diode 236, 237, and 238 correspond to window access switches in the master bedroom, boy's bedroom, and girl's bedroom of house 3. Light emitting diodes 67, 73 and 79 of the open loop portion of annunciator circuitry 1 are also shown on the annunciator panel surface of FIG. 2. Similarly, momentary slide switches 29A, 29B, 29C and 25A, 25B (previously referred to) are actuatable from the annunciator panel of FIG. 2. The annunciator panel of FIG. 2 can be located at any convenient location in the house of FIGS. 1A and 1B, such as on the wall adjacent the main entry.

In FIG. 1B, annunciator circuitry is disclosed for connection to a portion of burglar alarm sensing circuitry 83, which portion detects an "open loop" connection of access switches which are normally opened and which are closed to indicate intrusion by an intruder. (It should be noted that most commercially available burglar alarm sensing units are of the "closed loop" variety, although some commercially available units are capable of sensing closure of normally open access switches. For convenience, reference numeral 83 is used to denote a single unit having both capabilities.) It should be noted that burglar alarm sensing circuit 83 could be implemented by means of two separate sensing circuits, one being an open-loop sensing circuit and the other being a closed-loop sensing circuit. Floor mats 13, 21, and 23 have associated therewith normally open access switches 13A, 21A, and 23A which are closed if an intruder steps on their associated floor mats.

When momentary switch 29C is in its relaxed configuration (as shown in FIG. 1B), conductor 123 is shorted by means of the upper slide plate of momentary switch 29C to conductor 97, which is connected to the open-loop sensing portion of burglar alarm sensing circuit 83.

Still referring to FIG. 1B, the cathodes of diodes 65, 71, and 77 are connected to conductor 123. The anode of diode 65 is connected to conductor 125, which is also connected to one terminal of normally opened access switch 13A, the other terminal of which is connected to conductor 121. Conductor 121 is connected to terminal 102 of momentary switch 25B, the wiper of which is connected via the lower wiper of momentary switch 29C to conductor 93. Thus, when access switch 13A is opened, no current flows through conductors 93 and 97, indicating no intruder has stepped on floor mat 13 to close normally open access switch 13A. The anode of diode 71 is similarly connected to conductor 127 to one terminal of normally opened switch 21A, the other terminal of which is connected to conductor 121. Similarly, the anode of diode 77 is connected to conductor 129, which is connected to one terminal of normally opened access switch 23A, the other terminal which is also connected to conductor 121.

In operation, as long as momentary switch 29C is in its relaxed configuration and momentary switch 25B is in its relaxed configuration (as shown in FIG. 1B) no current flows through conductors 93 and 97. However, if one of the normally opened access switches is closed as a result of its mat being stepped on by an intruder, a current does flow through conductors 97 and 93. Burglar alarm sensing circuitry 83 then causes relay 81 to actuate, causing sirens 31A and 31B to emit a loud warning sound.

If an operator slides the slide control of momentary switch 29A, 29B, 29C to the left, and does not actuate momentary switch 25A, 25B, the positive output voltage of voltage regulator 27 is applied to the anodes of light emitting diodes 67, 73 and 79. Also, the negative output voltage of voltage regulator 27 is connected to terminal 164 of momentary switch 29C, and hence to conductor 121 via unactuated momentary switch 25B. Conductors 93 and 97 are disconnected from the normally open access switches 13A, 21A and 23A. If no intruder has steped on any of mats 13, 21 or 23, none of normally open access switches is closed, and consequently none of light emitting diodes 67, 73 or 79 is on. This means that the sensing unit 83 can be "armed" or "set" without setting off sirens 31A and 31B. However, if one of access switches 13A, 21A or 23A is on (because, for example, someone has inadvertently placed a heavy weight on one of the mats), the corresponding light emitting diode will turn on, indicating to the operator that he should check that mat and remove the weight before arming sensing unit 83.

If the operator then actuates both momentary switch 29A, 29B, 29C and momentary switch 25A, 25B so that the wiper of momentary switch 25B contacts terminal 108 instead of 102, then the positive terminal of voltage regulator 27 is electrically connected to conductor 123 and the negative terminal of voltage 27 is electrically connected to terminal 108. This causes currents to flow through each of light emitting diodes 67, 73 and 79 and through diodes 63, 69, and 75, respectively to conductor 119, enabling the operator to test those light emitting diodes for operability regardless of the state of any of the access switches.

Thus, it is seen that momentary switch 25A, 25B performs the sole function of testing light emitting diodes 33, 35, 37, 39, 67, 73 and 79. Operation is as follows: momentary switch 29A, 29B, 29C is actuated so that its wiper plates are slid to the left in FIGS. 1A and 1B and is held in that position. Then momentary switch 25A, 25B is actuated so that its wipers contact terminals 104 and 108, respectively. This produces a current flowing through each of the above mentioned light emitting diodes. If desired, a suitable current limiting resistor can be placed in a series with each of terminals 104 and 108. It should be noted that momentary switch 25A, 25B remains in its "relaxed" configuration (the configuration shown in FIGS. 1A and 1B) when momentary switch 29A, 29B, 29C is actuated to monitor the status of all of the access switches shown in FIGS. 1A and 1B.

While the invention has been described with reference to the several particular embodiments thereof shown in FIGS. 1A and 1B, those skilled in the art will be able to make various modifications to the disclosed embodiments of the invention without departing from the true spirit and scope of the invention, as set forth in the appended claims.

I claim:

1. An annunciator circuit for displaying information identifying individual open access switches in a closed loop burglar alarm system, the burglar alarm system including:

(i) first and second access switches each having a first terminal and a second terminal, said first and second access switches being normally closed access switches, and (ii) a sensing unit having first and second terminals thereof, said annunciator circuit comprising in combination:

a. a first display element having first and second terminals, and first means for coupling the second terminal of said first display element to the first terminal of said first access switch;

b. a second display element having first and second terminals and second means for coupling the second terminal of said second display element to the first terminal of said second access switch;

c. a voltage source having first and second terminals, the voltage on the first terminal of said voltage source being greater than the voltage on the second terminal thereof by a predetermined voltage difference;

d. a first diode having an anode coupled to the second terminal of said first access switch and a cathode coupled to the first terminal of said second access switch;

e. first switching means for selectively coupling the first terminal of said first access switch to the first terminal of said sensing unit and for selectively coupling the second terminal of said second access switch to the second terminal of said sensing unit;

f. a second diode having an anode coupled to the second terminal of said first access switch;

g. a third diode having an anode coupled to the second terminal of said second access switch; and h. a second switching means for selectively coupling the first terminal of said voltage source to the first terminals of said first and second display elements when said first and second terminals of said sensing unit are decoupled from said first and second terminals of said first and second access switches, respectively, and for coupling the second terminal of said voltage source to the cathodes of said second and third diodes if said first and second terminals of said sensing unit are decoupled from said first and second terminals of said first and second access switches, respectively.

2. The annunciator circuit of claim 1 further including a plurality of additional access switches connected in a series with said first and second access switches, said plurality of additional access switches being normally closed access switches.

3. The annunciator circuit of claim 2 further including a plurality of additional display elements each having first and second terminals, said plurality of additional access switches also each having a first and second terminals and a plurality of coupling means for coupling the respective second terminals of said plurality of additional display elements to the respective first terminals of said plurality of additional access switches.

4. The annunciator circuit of claim 1 wherein said first and second display elements include light emitting diodes, the first terminal of each of said first and second display elements being an anode and a second terminal of each of said first and second display elements being a cathode.

5. The annunciator circuit of claim 1 further including an audible alarm element having first and second terminals, said sensing unit having a third and a fourth terminals thereof, said annunciator circuit including third switching means for selectively coupling said first and second terminals of said audible alarm element to the third and fourth terminals of said audible alarm element to the third display element having first and second terminals, and fourth switching means for selectively coupling the first terminal of said audible alarm element to the first terminal of said first access switch and for selectively coupling the second terminal of said audible alarm element to the second terminal of said third display element, said second switching means selectively coupling the first terminal of said voltage source to the first terminal of said third display element at the same time that said second switching means couples the first terminal of said voltage source to the first terminal of said first and second display elements, said third switching means decoupling said first and second terminals of said audible element from said third and fourth terminals of said sensing unit when said fourth switching means couples said first and second terminals of said audible alarm element to said first access switch and said third display element, respectively.

6. The annunciator circuit of claim 1 wherein said first and second switching means are incorporated in a single momentary switch device which couples said first and second access switches to said sensing unit and decouples said first and second display elements from said voltage source when said single momentary switch is in a relaxed configuration and where said single momentary switch device both couples said first and second display elements to said voltage source and decouples said first and second access switches from said sensing unit when said single momentary switch is actuated.

7. The annunciator circuit of claim 6 wherein said first and second display elements and said momentary switch are installed in an annunciator panel.

8. The annunciator circuit of claim 1 further including first and second test diodes each having an anode connected to the respective second terminals of said first and second display elements, and third switching means for selectively coupling the cathodes of said first and second test diodes to the second terminal of said voltage source to effect testing of said first and second display elements.

9. An annunciator circuit for displaying information identifying individual closed access switches in an open loop burglar alarm system, the burglar alarm system including:

(i) first and second access switches each having a first terminal and a second terminal, said first and second access switches being normally open access switches, and (ii) a sensing unit having first and second terminals thereof, said annunciator circuit comprising in combination:

a. a first display element having first and second terminals, and first means for coupling the second terminal of said first display element to the first terminal of said first access switch;

b. a second display element having first and second terminals and second means for coupling the second display element to the first terminal of said second access switch;

c. a voltage source having first and second terminals, the voltage on the first terminal of said voltage source being greater than the voltage on the second terminal thereof by a predetermined voltage difference;

d. first switching means for selectively coupling the first terminals of said first and second access switches to the first terminal of said sensing unit and for selectively coupling the second terminals of said first and second access switches to the second terminal of said sensing unit;

e. a first diode having an anode and a cathode coupled to the second and first terminals, respectively, of said first access switch;

f. second switching means for selectively coupling the first terminal of said voltage source to the first terminals of said first and second display elements when said first and second terminals of said sensing unit are not coupled to said first and second terminals of said first and second access switches, respectively.

* * * * *